US006899445B2

(12) United States Patent
Hyder

(10) Patent No.: US 6,899,445 B2
(45) Date of Patent: May 31, 2005

(54) ATTACHMENT FOR A REFLECTOR IN A LIGHT ASSEMBLY

(75) Inventor: LaShannon Hyder, Greer, SC (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/214,461

(22) Filed: Aug. 7, 2002

(65) Prior Publication Data

US 2004/0027832 A1 Feb. 12, 2004

(51) Int. Cl.[7] ..... F21V 17/14; F21S 8/02

(52) U.S. Cl. ..... 362/368; 362/365; 362/148; 362/296

(58) Field of Search ..... 362/364–365, 362/368, 433, 148, 150, 296, 341, 404

(56) References Cited

U.S. PATENT DOCUMENTS

| | | | | |
|---|---|---|---|---|
| 2,143,673 A | | 1/1939 | Baumgartner | |
| 2,201,094 A | | 5/1940 | Kassel | |
| 2,456,903 A | | 12/1948 | Versen | |
| 2,892,076 A | | 6/1959 | Moos | |
| 3,524,981 A | * | 8/1970 | Auerbach | 362/433 |
| 4,287,554 A | | 9/1981 | Wolff | |
| 4,314,223 A | | 2/1982 | Kristofek | |
| 4,336,575 A | | 6/1982 | Gilman | |
| 4,336,576 A | | 6/1982 | Crabtree | |
| 4,425,604 A | | 1/1984 | Imai et al. | |
| 4,450,512 A | | 5/1984 | Kristofek | |
| 4,499,529 A | | 2/1985 | Figueroa | |
| 4,669,033 A | | 5/1987 | Lee | |
| 4,729,080 A | | 3/1988 | Fremont et al. | |
| 4,754,377 A | | 6/1988 | Wenman | |
| 5,062,030 A | | 10/1991 | Figueroa | |
| 5,192,129 A | | 3/1993 | Figueroa | |
| 5,199,786 A | | 4/1993 | Baliozian | |
| 5,253,151 A | | 10/1993 | Mepham et al. | |
| 5,355,291 A | | 10/1994 | Subisak et al. | |
| 5,707,143 A | * | 1/1998 | Hentz | 362/365 |
| 6,024,470 A | | 2/2000 | Wang | |
| 6,079,851 A | | 6/2000 | Altman et al. | |
| 6,254,257 B1 | | 7/2001 | Sieczkowski | |

* cited by examiner

*Primary Examiner*—Sandra O'Shea
*Assistant Examiner*—Guiyoung Lee
(74) *Attorney, Agent, or Firm*—Alfred N. Goodman; Mark S. Bicks; Michael E. Stimson

(57) ABSTRACT

A light assembly with a removable reflector for use in a ceiling, wall, or the like is provided. The reflector has a top surface with a substantially hurricane-shaped mounting aperture defined by a primary diameter and a secondary diameter that intersect each other and in which the primary diameter is greater than the secondary diameter. When the reflector is rotated, the secondary diameter approaches a holding key in the light assembly, which engages the top surface to releasably hold the reflector within the light assembly. A method of releasably installing the reflector is also described.

40 Claims, 7 Drawing Sheets

ATTACHMENT FOR A REFLECTOR IN A LIGHT ASSEMBLY

BACKGROUND OF THE INVENTION

A recessed lighting assembly typically includes a housing attached to a structure such as a joist above a ceiling. A reflector is installed within the housing opening into the ceiling. The reflector may include holes in which light elements are operatively attached and replaced and is usually at least semi-permanently installed in the housing to reflect light from the light elements in a direction from the ceiling through an opening in the reflector into a room below.

Generally, a body of the reflector is conically or cylindrically shaped and has a flat top surface opposite the reflector's opening. A generally circular cutout is made in the top surface through which holding springs or clips extend to hold the reflector semi-permanently in the housing. Once the clips have been retracted and released to insert and hold the reflector, the reflector is difficult if not impossible to remove. For instance, if a consumer wishes to replace a reflector to accommodate a new color preference, the clips must be squeezed while the reflector is pulled downward simultaneously. Often, the entire structure typically needs to be removed from the ceiling in order to release the reflector from the clip. Moreover, the clips or the reflector are bent or scratched during such a removal operation. A need exists for a method and device for removing a reflector in a recessed lighting fixture without damaging components of the recessed lighting assembly or having to remove the entire assembly.

BRIEF SUMMARY OF THE INVENTION

The present invention provides a versatile reflector for a recessed light assembly for use in a ceiling, a wall or the like. In one aspect of the invention, a light assembly is disposed in an opening of a ceiling in which a reflector is removably attachable in the light assembly via a holding key. The reflector has a top surface with a mounting aperture that has a primary diameter and a secondary diameter intersecting each other. The primary diameter is greater than the secondary diameter to form a "hurricane-shaped" mounting aperture. When the reflector is inserted in the light assembly in a first position, the holding key extends through the mounting aperture and is spaced apart from the top surface in substantial alignment with the primary diameter. The reflector can then be rotated such that the secondary diameter of the top surface approaches the holding key. The holding key slidably engages a camming portion of the top surface to releasably hold the reflector in a second position within the light assembly.

In another aspect of the invention, a reflector, in some ways similar to the foregoing example, exhibits different dimensions to accommodate different ceiling recess depths. Moreover, concentric rings are disposed about the reflector for both aesthetic purposes and to help with directing emitted light from the light fixture.

In a further aspect of the invention, a method is disclosed for installing a reflector in a light assembly. Similar to the foregoing embodiments, the reflector includes a generally cylindrical bottom section defining a circular opening, which is configured to emit light from a light source operatively disposed in the light assembly. A substantially enclosed top section of the reflector depends from the bottom section and defines a top surface with a mounting aperture. The mounting aperture has a primary diameter and a secondary diameter, which intersect each other and form a hurricane-shaped aperture. The method includes the steps of inserting the reflector in a housing of the light assembly and placing the mounting aperture proximate a retaining key depending from near the light source such that the retaining key extends through the mounting aperture. The reflector is then rotated such that the secondary diameter of the top surface is presented to the retaining key. The retaining key slidably engages a camming portion of the top surface to releasably hold the reflector in the light assembly.

Through the teachings of the present invention, a recessed lighting fixture is provided that includes an easily removable reflector. The reflector can be removed for instance and replaced with a reflector having a different color, a different shape, or any other different design as desired. Additionally, inspectors can more easily rotate and remove the reflector to inspect electrical connections.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Repeat use of like or similar reference characters in the present specification and drawings is intended to represent same or analogous features or elements of the invention.

DETAILED DESCRIPTION OF THE INVENTION

Figure 1:
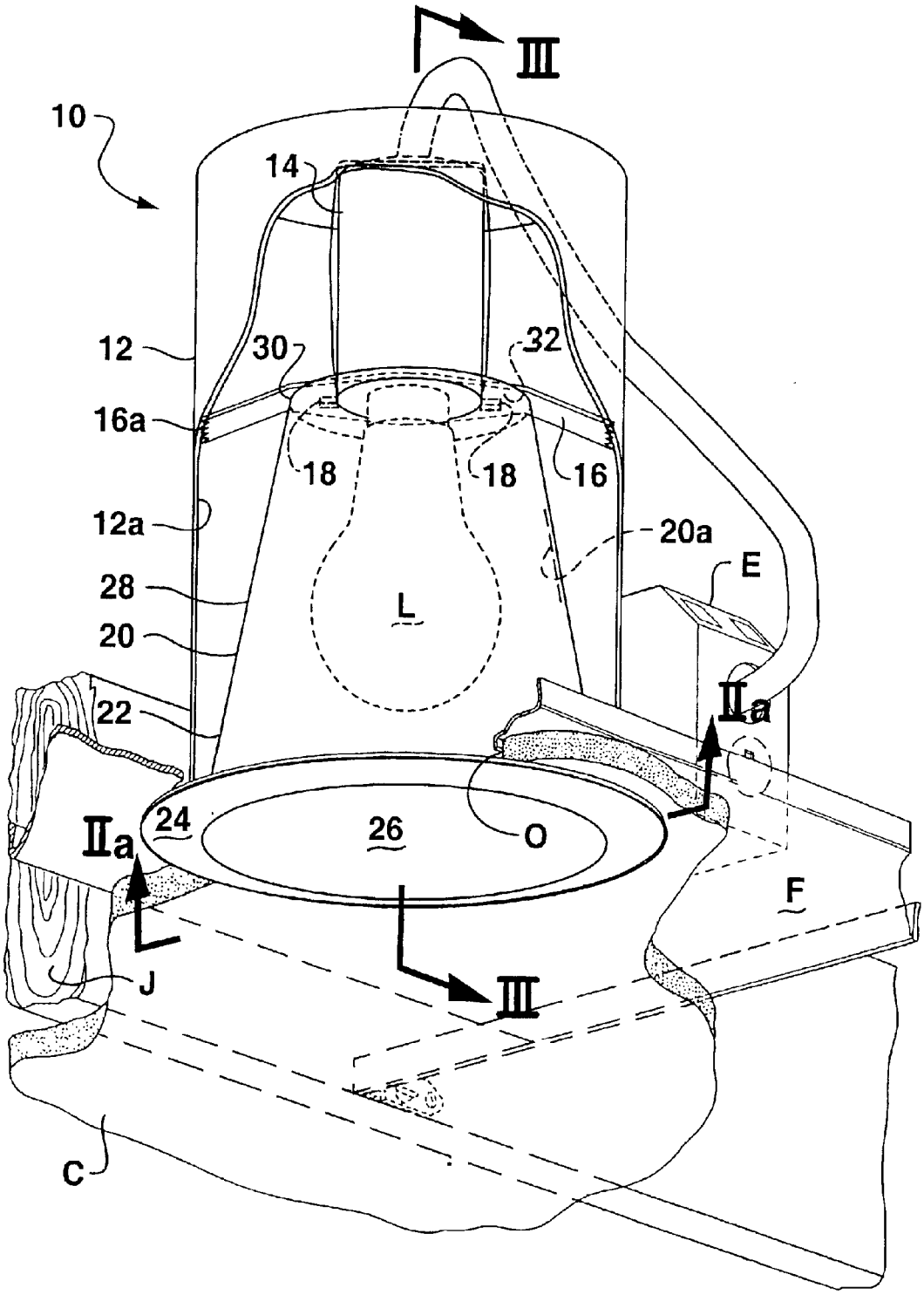
FIG. 1 shows a light assembly installed in a ceiling in which a partial cut-away view of a housing and a reflector in accordance with an aspect of the present invention is illustrated.

Reference will now be made in detail to various embodiments of the invention, one or more examples of which are illustrated in the accompanying drawings. Each example is provided by way of explanation of the invention, not limitation of the invention. In fact, it would be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As broadly embodied in FIGS. 1–4C, a recessed light assembly, generally designated by the numeral 10, is provided with a housing 12 attached to a socket or ceramic light fixture 14. The light assembly 10 is recessed in a recess or opening O of a ceiling C. The light fixture 14 is connected to a power supply E to supply electricity to a light bulb L as known in the art. The light bulb L is surrounded by a reflector 20, which serves to reflect light from the light bulb L into a room away from the ceiling C. Although the light assembly 10 is shown with a conventional light bulb L, other light sources such as relatively short flourescent tubes, typically between 4 inches and 8 inches in length, may be utilized. Moreover, although the inventive light assembly 10 is described by example herein with reference to ceilings, it is to be understood that the light assembly 10 is contemplated for use in walls, floors, and other environments that utilize light assemblies and is not limited to use only in ceilings.

Referring more specifically to FIG. 1, the light assembly 10 opens into the opening O at the ceiling surface C. The housing 12 is attached to the ceiling C in any suitable manner such as via a frame F and joist J. The housing 12 is further attached to the ceramic light fixture 14 by a retainer 16, which itself is attached to the ceramic light fixture 14 by screws 17 or the like and/or a clip 18 (see, e.g., FIG. 4A). Retainer 16 has a pre-determined length, which coupled with a plurality of teeth 16*a*, maintain the ceramic light fixture 14 immovable with respect to the housing 12 when the retainer 16 is attached to the light fixture 14.

In one aspect, retainer 16 is a spring-like metal leaf, which is press-fit against an interior 12*a* of the housing 12 and attached to the ceramic light fixture 14 to hold the ceramic light fixture 14 stationary in the housing 12. The plurality of teeth 16*a* provide various point-bearing surfaces that individually press and hold against the interior 12*a*, which may better anchor the retainer 16 in the housing 12 than a single point-bearing surface. Determining the proper length of retainer 16 and size, orientation and number of teeth 16*a* are thus dependent upon an inner diameter of the housing 12 to ensure the correct press-fit of retainer 16 therein.

Figure 2A:
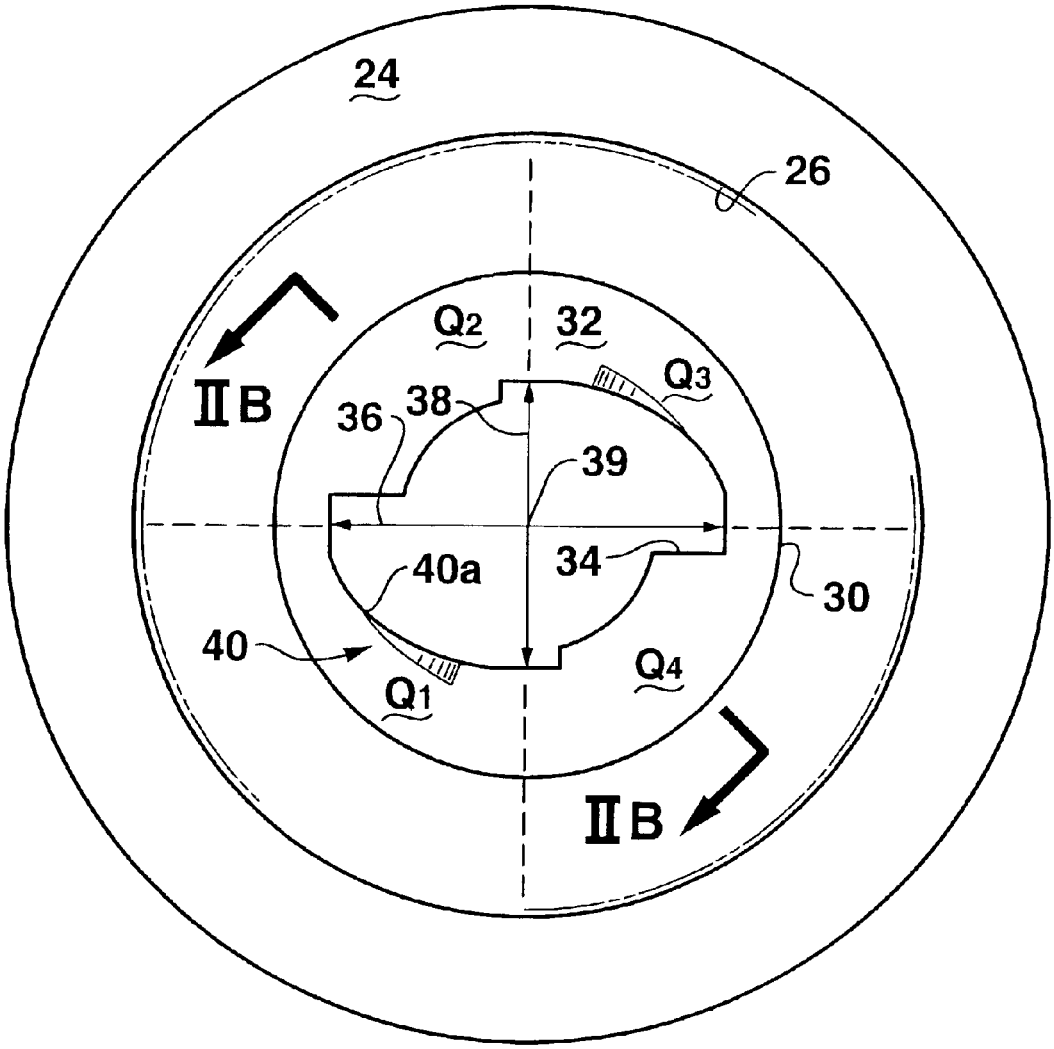
FIG. 2A shows a plan view of the light assembly of FIG. 1 taken along line IIa—IIa with a light fixture removed for clarity and particularly showing a mounting aperture in accordance with an aspect of the invention.
Figure 3:
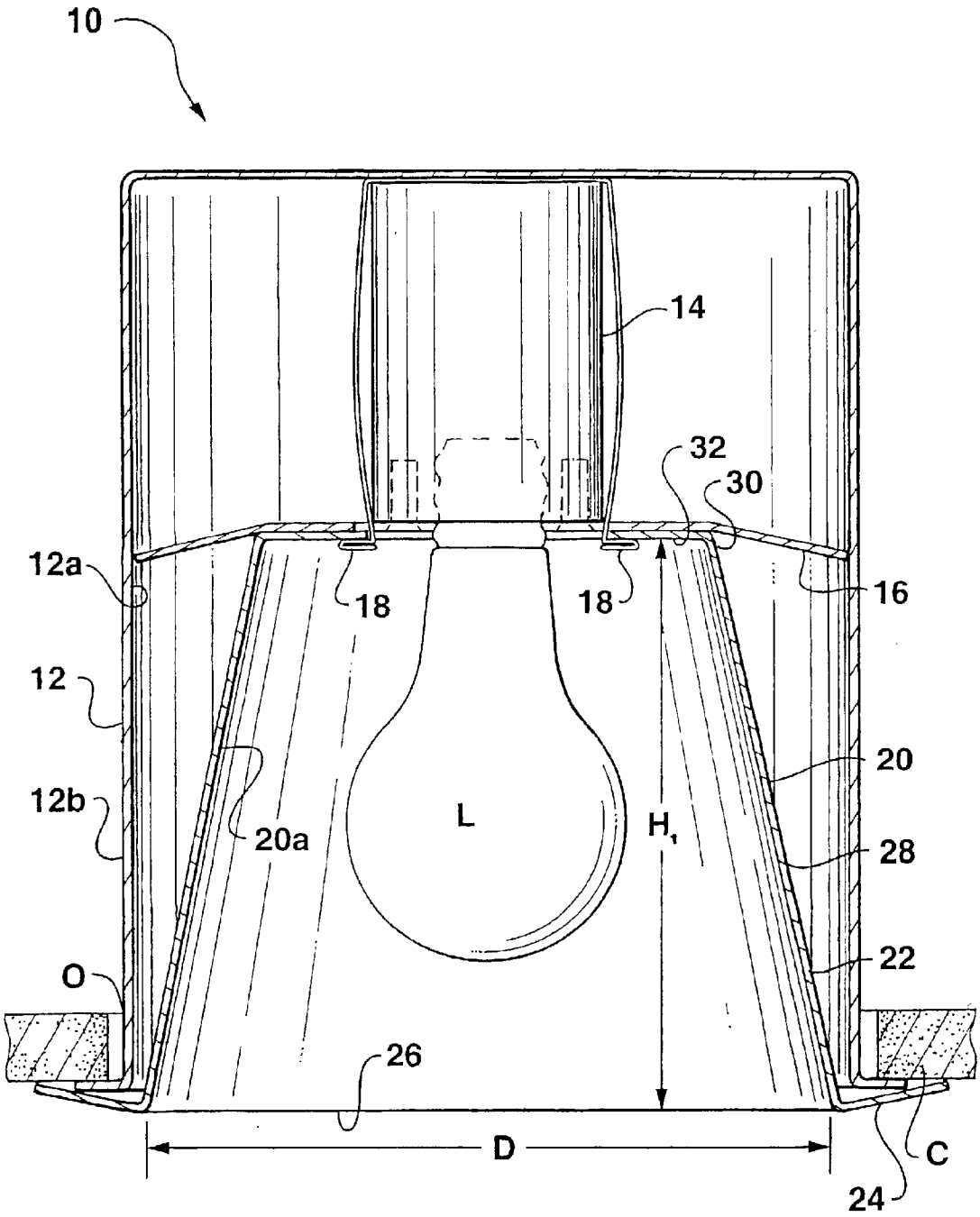
FIG. 3 shows a partial, sectional side view of the light assembly taken along line III—III of FIG. 1.

As seen most clearly in FIGS. 1 and 3, the reflector 20 has a bottom section 22, a side section 28, and a top section 30. The bottom section 22 defines a flange 24 and a light opening 26. The top section 30 defines a top surface 32 and a mounting aperture 34 (see, e.g., FIG. 2A), discussed in greater detail below. The depth or height $H_1$ of the reflector 20, as measured between the light opening 26 and the top surface 32, is approximately 4 inches in this example, but may be any height as required (see discussion below regarding FIG. 6). Therefore, it should be understood that the particular dimensions and design of reflector 20 may vary significantly according to the needs of a particular system and/or space limitations in the ceiling C. For example, the height $H_1$ of the reflector 20 is typically no greater than approximately 5.5 inches when the ceiling is constructed using 2 inch by 6 inch joists J. Accordingly, a diameter D of the light opening 26 is typically proportionally between approximately 4 inches and approximately 8 inches to focus the emitted light and for aesthetic purposes.

As will be discussed in greater detail below, when the reflector 20 is inserted in the housing 12, the flange 24 operates to cover unsightly gaps (not shown) that may exist between the housing 12 and the ceiling opening O resulting from, for instance, roughing-in the opening O. Light from the light bulb L, of course, is emitted through the light opening 26 into a room from the light assembly 10.

With further reference to FIGS. 1 and 3, the side section 28 of the reflector 20 tapers inwardly from the bottom section 22 in a direction of the top section 30. The resulting conically-shaped reflector 20 helps direct the light from the light assembly 10 into the nearby room. It should be understood that any shape, such as cylindrical, round, or the like can be used for the reflector 20 instead of the shape illustrated.

Reflector 20 may be formed by a hydraform process in which an aluminum blank is placed over a male die (not shown) shaped to form an inner surface 20*a* of the reflector 20. The die is pushed into the blank from one side to form the interior surface 20*a*. At the same time, liquid is applied under pressure to the opposite side of the blank to maintain relatively uniform pressure on an outer surface 12*b* of the reflector 20 as it is formed by the male die. Such processes should be familiar to those skilled in the art and are therefore not discussed in further detail herein.

While one material for use in forming reflector 20 is aluminum, it should be understood that any suitable material may be used such as tin, bronze, brass, alloys, a plastic or polymeric material or the like. Once the material has been shaped, it is polished by any suitable method, as should be well understood in this art. Following polishing, further techniques may be used to increase a reflectivity (that is, the percentage of light incident on the surface that is reflected) of the interior surface 20*a*. In general, it is preferred that the reflector's interior surface 20*a* be at least approximately 75% reflective. In these and other constructions, the reflector's interior surface 20*a* may be painted white so that the reflectivity is approximately 85%. In other cases, it is desirable that light from the reflector 20 be relatively diffused, and coverings may be provided over the light opening 26 for this effect. For instance, in an aspect of the invention discussed further herein, a prismatic lens 148 is releasably fittable proximate the flange 24.

In other embodiments, a specular surface is desired, and several suitable methods may be used to produce such a highly reflective surface 20*a*. For example, those skilled in the art should be familiar with aluminum anodizing processes, which coat the aluminum with an oxide layer through the use of an electrolyte such as chromic acid or sulfuric acid. One preferred anodizing finish is an ALZAK finish, available from licensed distributors from Alcoa Corporation. A 3002 grade aluminum should be used where an ALZAK finish is employed, whereas an 1100 series aluminum is typically otherwise suitable.

Figure 2B:
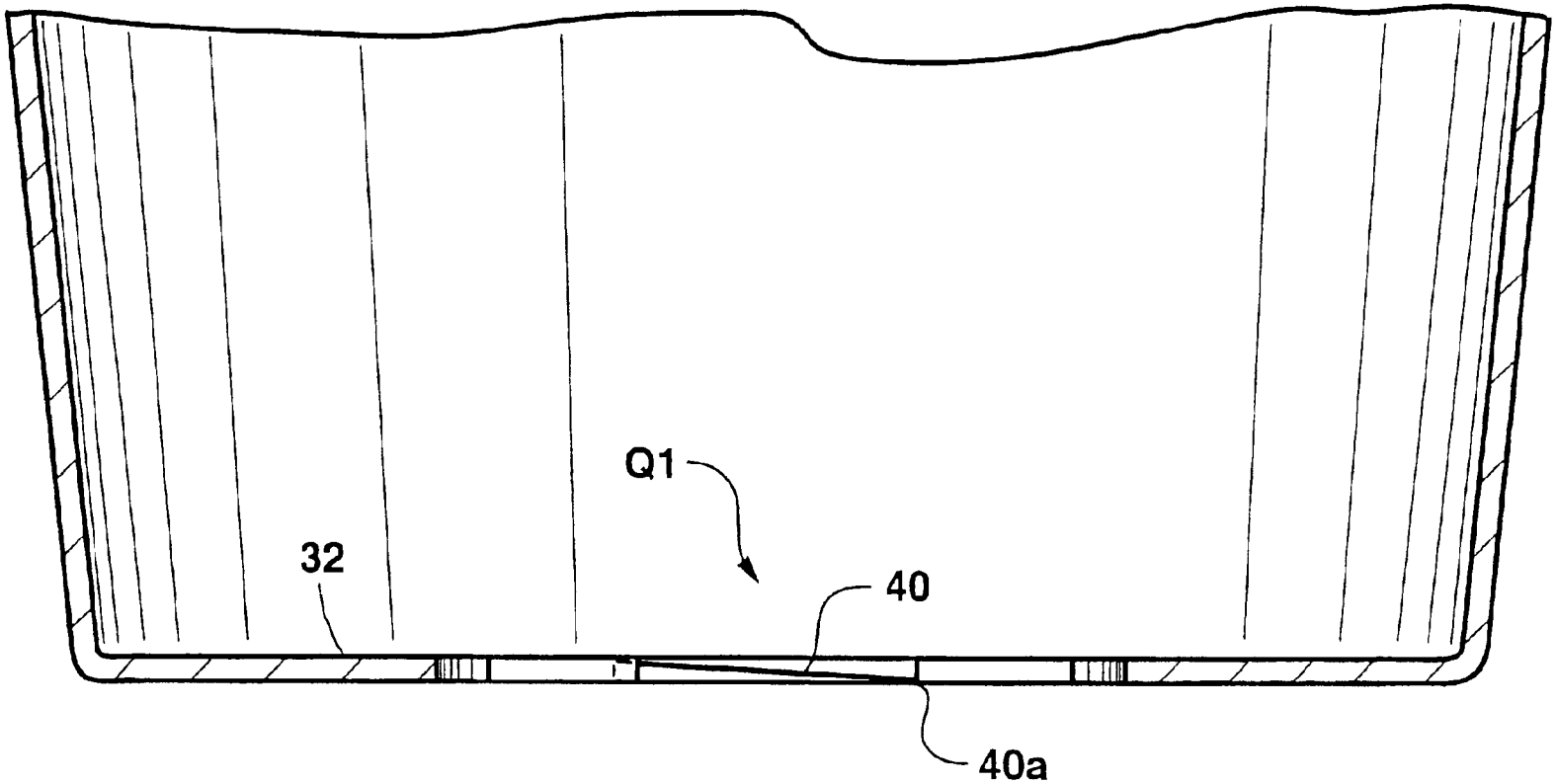
FIG. 2B shows a sectional side view taken along line IIb—IIb of FIG. 2A particularly showing a leading edge of a camming portion.

With reference to FIGS. 2A, 2B, and 3, the top section 30 of the reflector 20 depends from the bottom section 22 and is substantially enclosed. The top surface 32 of the top section 30 defines the mounting aperture 34, briefly introduced above, which has a primary diameter 36 and a secondary diameter 38 that form an intersection 39 with each other. In this aspect, the primary diameter 36 is greater than the secondary diameter 38. More specifically, in a clockwise direction, secondary diameter 38 gradually increases until it accurately transitions into the greater primary diameter 36.

An intersection 39 of diameters 36, 38 forms four quadrants $Q_1$, $Q_2$, $Q_3$, and $Q_4$. As seen in $Q_2$, $Q_4$ a more conventional circular opening can be imagined superimposed between inventive camming portions 40 in $Q_1$, $Q_3$ This unique arrangement provides a substantially "hurricane-shaped" mounting aperture 34, which greatly simplifies the removal of reflector 20 as compared to conventional reflectors in conventional lighting assemblies as will be described further below.

The camming portion 40 is disposed away from the intersection 39, for example, in quadrant $Q_1$ as seen in FIGS. 2A and 2B. FIG. 2B particularly shows that camming portion 40 may have an inclined leading edge or ramp 40A to assist the key or keys 18 to engage camming portion 40, discussed further below. It is to be noted that key, holding key, and retaining key are terms used interchangeably herein to describe key 18.

Key 18, as seen in FIG. 3, may be formed by an inverted, substantially U-shaped element affixed to the light fixture 14 at a closed portion of the "U" by rivets, screws or other conventional manner. In this aspect, the U-shaped element defines keys 18 at each of two prongs of the "U." The U-element is configured with a spring constant to urge the keys 18 against the retainer 16. It should be noted that key 18 may be individually attached elements and need not be integral with the U-shaped element described. Any number of conventional clip arrangements may thus be utilized satisfactorily with the present invention.

Figure 4A:
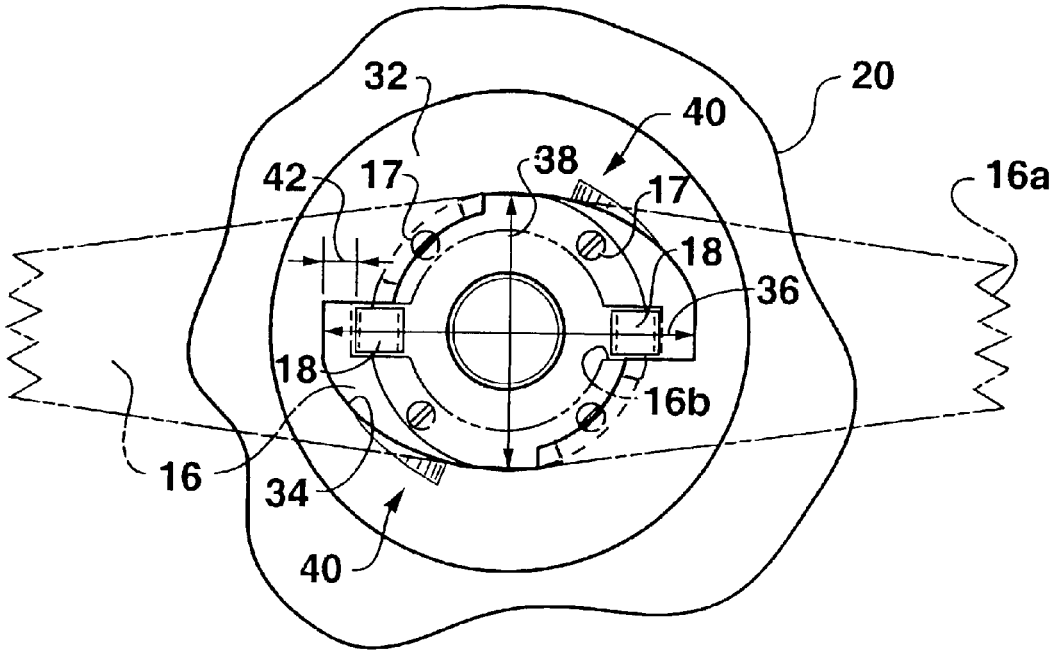
FIG. 4A illustrates the reflector inserted proximate a retainer and spaced apart from a holding key in accordance with an aspect of the invention.
Figure 4B:
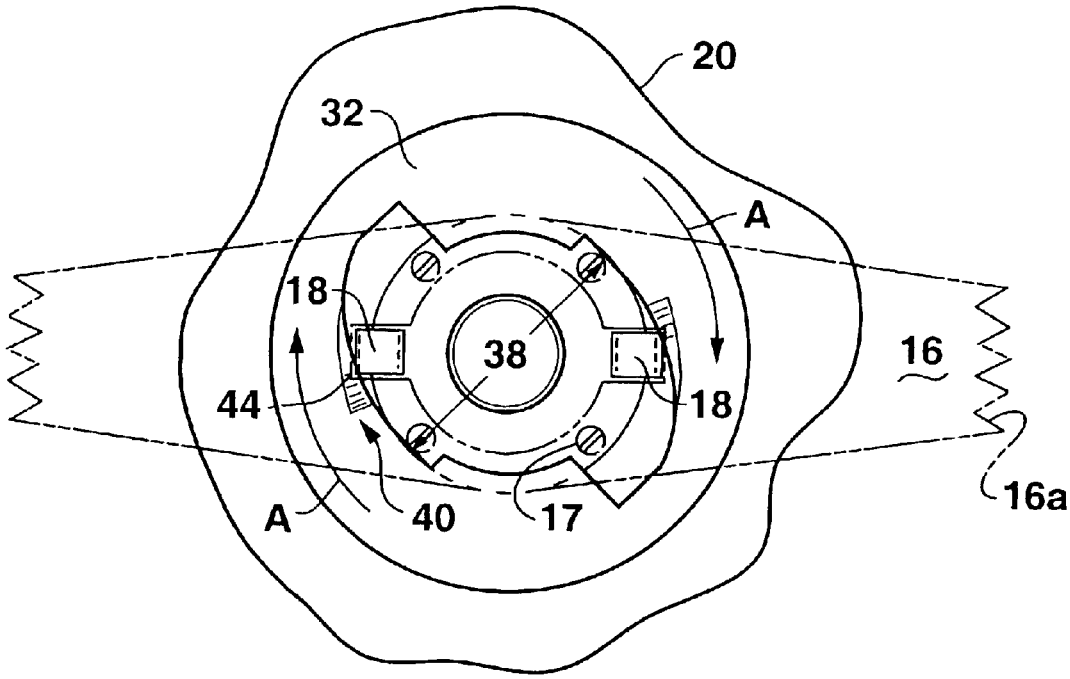
FIG. 4B shows the reflector of FIG. 4A rotated partly such that the holding key begins to overlap a portion of the reflector.
Figure 4C:
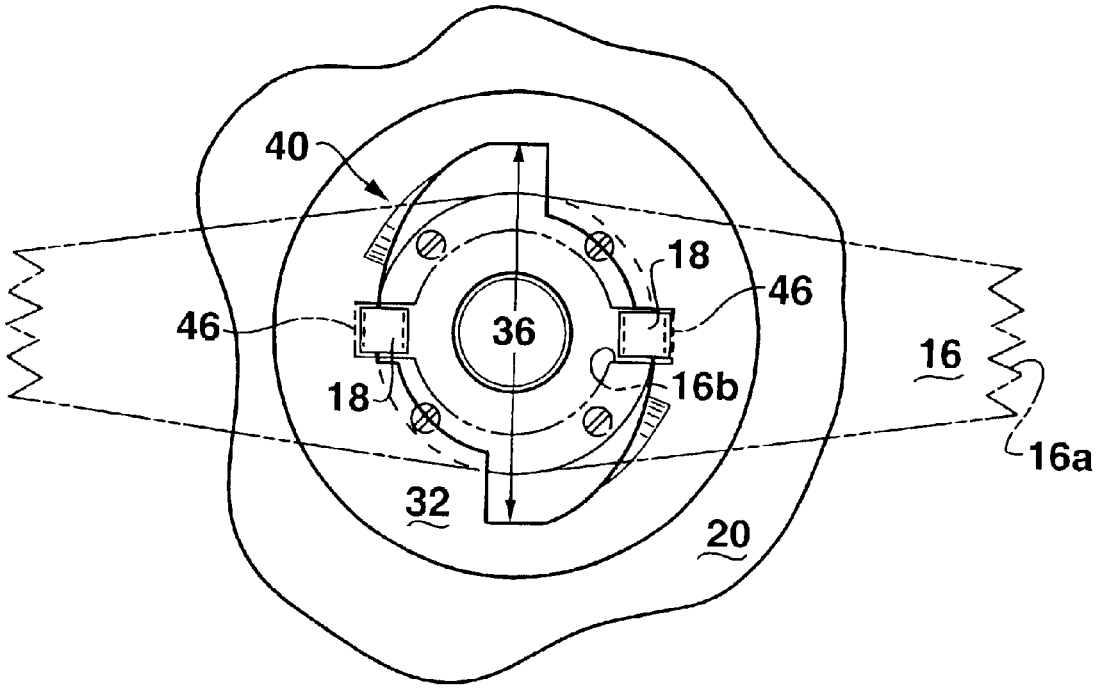
FIG. 4C shows the reflector of FIG. 4A rotated such that the holding key overlaps the reflector to removably hold the reflector in place within the light assembly.

The unique fastening system of the present invention is shown interconnecting the reflector 20 within the lighting assembly 10 in FIGS. 4A–4C. Specifically, seen in FIG. 4A, the key(s) 18 extends from proximate the ceramic light fixture 14 through keyway(s) 16*b* defined in retainer 16. (See also FIG. 3.)

To assemble the inventive reflector 20 within the lighting assembly 10, FIG. 4A shows that the reflector 20 is placed proximate the retainer 16 in a first position such that the key 18 extends through the mounting aperture 34 spaced apart from the top surface 32 in substantial alignment with the primary diameter 36. Stated another way, in this first position, the key 18 depends beneath both the retainer 16 and the top surface 32 as seen in FIG. 3 and, by not contacting the top surface 32, forms a space 42 as seen in FIG. 4A.

As seen in FIG. 4B, continued attachment of the reflector 20 to the retainer 16 is accomplished by applying slight longitudinal pressure as the reflector 20 is simultaneously rotated, for example, in a clockwise direction indicated by arrows A relative to the retainer 16. The slight longitudinal pressure compresses retainer 16 between top surface 32 and key 18. As the reflector 20 continues to be rotated in the direction A, the secondary diameter 38 approaches the key 18. Eventually the key 18 begins to engage a transition overlap portion 44 of the camming portion 40.

Alternatively, or in addition to the use of longitudinal pressure, the camming portion 40 may include the inclined leading edge 40A (introduced above with respect to FIG. 2A) to assist contact between key 18 and camming portion 40. If incorporated, the inclined leading edge 40A is integrally formed with the generally flat camming portion 40 as seen in FIG. 2B to help transfer the rotary motion of the reflector 20 such that the keys 18 more easily slidably engage the camming portion 40 to axially hold the top surface 32 of the reflector 20.

FIG. 4C shows the reflector 20 rotated to a second position in which the key 18 grips overlap portion 46 to hold the reflector 20 against the retainer 16. If not previously positioned in the housing 12, the retainer 16 (with reflector 20 now attached) is press-fit into the housing 12. By reversing the foregoing operation, reflector 20 may be removed for replacement, repainting, inspection of the ceramic light fixture 14, reuse in other light assemblies, and the like.

Although the foregoing example uses one or two keyways 16*b*, one or two keys 18, and one or two camming portions 40, it will be readily apparent to those skilled in the art that it may be possible to obtain acceptable results with different numbers of keys, keyways, and camming portions. Further, a stop (not shown) may be formed, for instance, on the top surface 32 to limit rotation of the reflector 20 to, for example, a quarter-turn. Moreover, the stop can be configured to limit rotation to one direction, e.g., clockwise, if desired.

Figure 5:
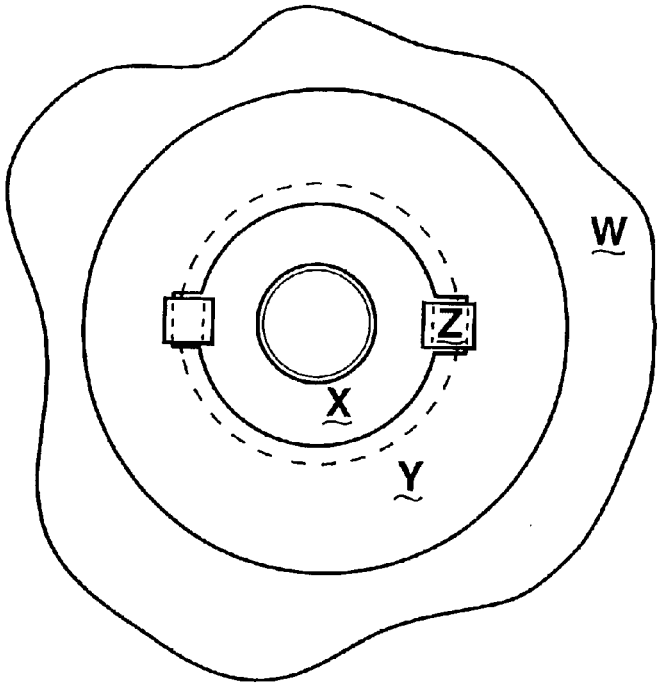
FIG. 5 Prior Art
FIG. 5 illustrates a conventional clip similar to the key in FIG. 4C in which the prior art clip overlaps a portion of a prior art reflector.

FIG. 5 shows a conventional reflector W in which a generally circular cut-out X is made in a top surface Y of the conventional reflector W through which conventional holding keys or clips Z extend to hold the reflector W semi-permanently in a conventional light assembly (partially shown). In other words, once the clips Z have been manipulated to snap-in and hold the reflector W to the light assembly, the reflector W cannot be simply rotated and removed. More specifically, in the illustrated prior art, the clips Z must be squeezed together while the reflector W is simultaneously pulled downward. It is to be noted that the present invention, as described in operation above, can advantageously utilize conventional clips Z in conjunction with the novel mounting aperture 34 to remove, replace, and/or inspect the reflector 20.

Figure 6:
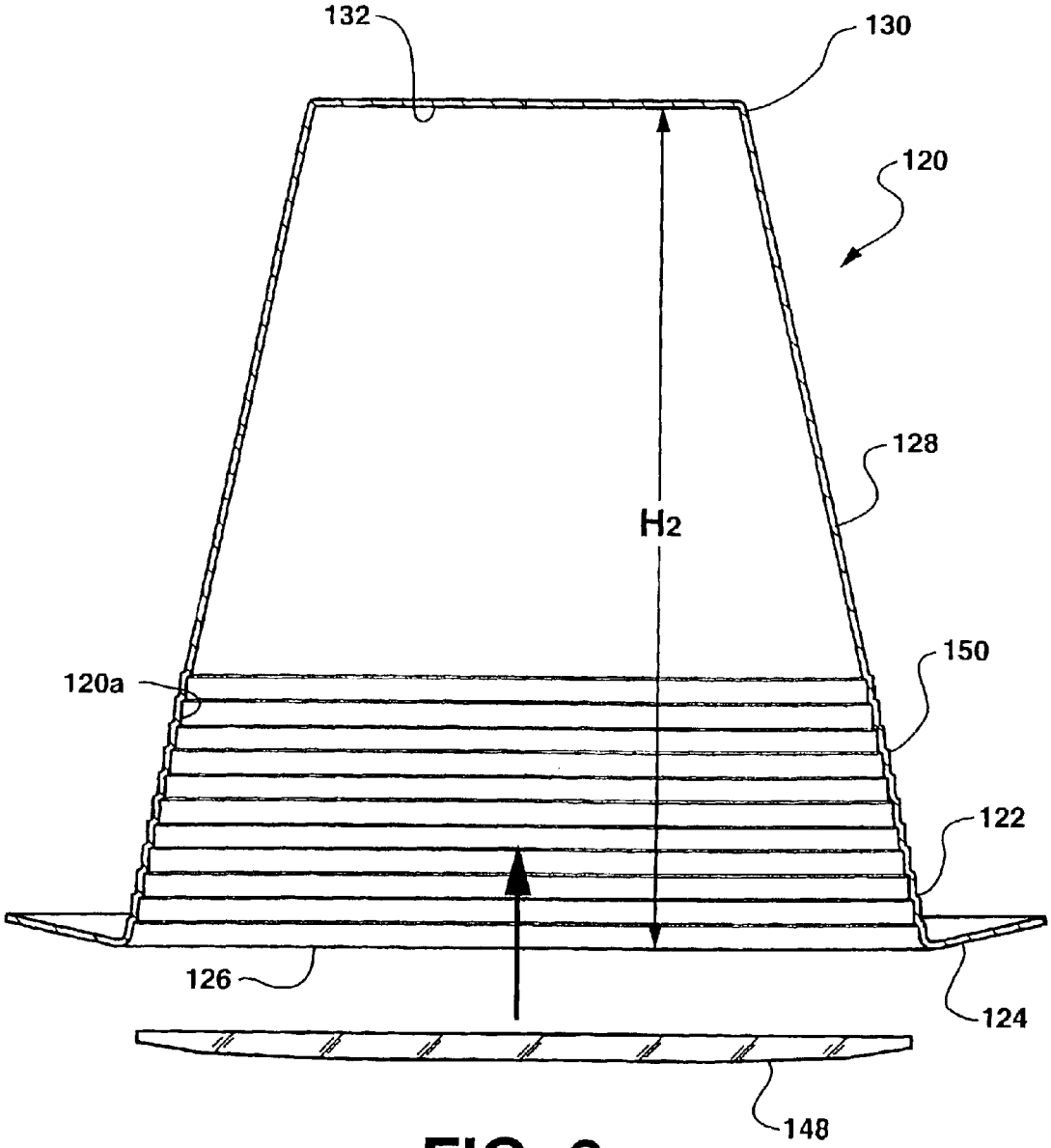
FIG. 6 illustrates an alternative reflector with ridges disposed on a side of the reflector in accordance with another aspect of the invention.

FIG. 6 illustrates another aspect of the present invention showing a reflector 120, which is similar in some ways, for instance, to the embodiment of FIGS. 1–3. The reflector 120 has a height $H_2$ as measured between a light opening 126 and a top surface 132, which is approximately 5 inches in this example but may be up to 12 inches or more as required. As earlier noted, it should be understood that the particular dimensions and design of reflector 120 may vary significantly according to the requirements of a particular system and/or space limitations in the ceiling C.

As seen in this example, the sides 128 taper inwardly from light opening 126 to top surface 132 so that light coming from light elements (not shown in FIG. 6) is reflected generally toward light opening 126. In the event multiple light elements are used, which may emit light obliquely from different areas proximate top surface 132, a plurality of ridges 150 may be provided on an inner surface 120*a* to further direct the light emitted from oblique angles toward light opening 126. The ridges 150 act to efficiently direct the light out of the reflector 120 to dissipate heat from the light elements.

While one or more embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the literal or equivalent scope of the appended claims.

It is also to be understood that references herein to "top," "lower," "bottom," and "side" structures or elements are intended solely for purposes of providing an enabling disclosure, and in no way suggest limitations regarding the operative orientation of light assembly 10 or any components thereof.

That which is claimed is:

1. A light assembly disposed in an opening of a surface and recessed therein, the light assembly comprising:

a reflector removably attachable in the light assembly via a holding key, the reflector having a top surface with a mounting aperture therethrough, the mounting aperture defining a primary diameter and a secondary diameter intersecting each other, wherein the primary diameter is greater than the secondary diameter, the reflector configured to be inserted in the light assembly in a first position such that the holding key extends through the mounting aperture, the holding key spaced apart from the top surface in substantial alignment with the primary diameter, the reflector configured for rotation such that the secondary diameter of the top surface approaches the holding key when the reflector is rotated, the holding key configured to slidably engage a camming portion of the top surface to releasably hold the reflector in a second position within the light assembly.

2. The light assembly of claim 1, wherein the primary and secondary diameters define the mounting aperture substantially in a hurricane shape.

3. The light assembly of claim 1, wherein the reflector defines a side portion tapering inwardly from a bottom section to the top surface of the reflector.

4. The light assembly of claim 3, further comprising a plurality of ridges defined in the side portion.

5. The light assembly of claim 4, wherein the plurality of ridges is defined concentrically on an inner surface of the reflector, the plurality of ridges configured to direct a light emission from the light assembly.

6. The light assembly as in claim 3, further comprising a flange depending from the bottom section, the flange configured to cover at least a part of the light assembly recessed in the surface.

7. The light assembly as in claim 6, further comprising a lens releasably fittable about the bottom section proximate the flange.

8. The reflector of claim 1, wherein the reflector is configured for clockwise or counterclockwise rotation.

9. The light assembly of claim 1, wherein the reflector is a metal selected from the group consisting of tin, aluminum, brass, bronze, and combinations thereof.

10. The light assembly as in claim 1, wherein the holding key is two holding keys depending from a ceramic light fixture positionable in the light assembly, the holding keys spaced apart from each other at a distance greater than the secondary diameter to define a spring constant, the holding keys configured to oppose movement of the reflector when the holding keys are substantially co-aligned with the secondary diameter.

11. The light assembly as in claim 10, further comprising the ceramic light fixture disposed in the light assembly for operatively holding a light bulb.

12. A reflector for a light assembly, the light assembly having a housing, a light fixture, a retainer, and a key, a portion of the housing fastenably disposed between the retainer and the light fixture such that the light fixture is disposed within the housing, the light fixture configured to operatively hold a light source, the retainer defining a keyway therethrough, the key depending from proximate the light fixture through the keyway and configured for releasably holding the reflector, wherein the light assembly opens at a surface and is recessed therein, the reflector comprising:

a bottom section defining an opening therethrough configured to emit light from the light source; and a substantially enclosed top section depending from the bottom section and defining a top surface with a mounting aperture therethrough, the mounting aperture defining a primary diameter and a secondary diameter that form an intersection with each other, wherein the primary diameter is greater than the secondary diameter, the reflector configured to be placed proximate the retainer in a first position such that the key extends through the mounting aperture and is spaced apart from the top surface in substantial alignment with the primary diameter, the reflector configured for rotation to a second position such that the secondary diameter approaches the key when the reflector is rotated, the key configured to slidably engage a camming portion of the top surface to releasably hold the reflector in the light assembly.

13. The reflector of claim 12, wherein the reflector is configured for clockwise or counterclockwise rotation.

14. The reflector of claim 12, wherein the intersection of the primary and secondary diameters form four quadrants, the camming portion disposed away from the intersection in one of the four quadrants.

15. The reflector of claim 14, wherein the camming portion is at least two camming portions, one of the camming portions disposed away from the intersection in one of the four quadrants, another of the camming portions disposed away from the intersection substantially opposite the one camming portion.

16. The reflector of claim 14, wherein the mounting aperture is substantially hurricane-shaped.

17. The reflector of claim 14, wherein the camming portion defines at least one leading edge having an inclined surface that becomes integral with a generally flat intermediate section of the camming portion.

18. The reflector of claim 12, further comprising at least two keys and at least two complementary keyways, each of the at least two keys depending from proximate the light fixture through a respective one of the complementary keyways to releasably hold the reflector.

19. The reflector of claim 12, further comprising a flange depending from the bottom section, the flange configured to block at least a part of the housing from view.

20. The reflector of claim 12, wherein the reflector defines a side portion tapering inwardly from the bottom section to the top surface.

21. The reflector of claim 12, wherein the reflector is substantially dome-shaped to dissipate heat from the light emission.

22. The reflector of claim 12, wherein a plurality of ridges are defined in the side portion.

23. The reflector of claim 22, wherein the plurality of ridges are concentrically disposed about the side portion and configured to direct the light emission.

24. The reflector of claim 12, wherein the reflector is made of metal.

25. The reflector of claim 24, wherein the metal is selected from the group consisting of aluminum, tin, brass, bronze and combinations thereof.

26. The reflector of claim 12, wherein the reflector is made of thermoplastic.

27. The reflector of claim 12, further comprising a lens releasably fittable about the opening of the bottom section proximate the flange.

28. The reflector of claim 27, wherein the lens is a prismatic lens configured to change an intensity or color of the light emission.

29. The reflector of claim 12, wherein the reflector is from between 2.5 inches to about 5.5 inches in height from proximate the opening in the bottom section to proximate the top portion.

30. A method for installing a reflector in a light assembly, the light assembly opening at a surface and recessed therein, the method comprising the steps of:

a) inserting the reflector in a housing of the light assembly, the reflector including a generally cylindrical bottom section defining an opening therethrough configured to emit light from a light source operatively disposed in the light assembly; and a substantially enclosed top section depending from the bottom section and defining a top surface with a mounting aperture therethrough, the mounting aperture defining a primary diameter and a secondary diameter intersecting each other, wherein the primary diameter is greater than the secondary diameter;

b) placing the mounting aperture proximate a retaining key depending from proximate the light source, the retaining key configured to extend through the mounting aperture, the retaining key spaced apart from the top surface in substantial alignment with the primary diameter; and c) rotating the reflector such that the secondary diameter of the top surface is presented to the retaining key as the reflector is rotated, the retaining key configured to slidably engage a camming portion of the top surface to releasably hold the reflector in the light assembly.

31. The method of claim 30, wherein the reflector is configured for clockwise or counterclockwise rotation in step c.

32. The method of claim 30, wherein the camming portion is at least two camming portions, the at least two camming portions disposed substantially opposite each other away from an intersection of the primary and secondary diameters such that the mounting aperture is substantially hurricane-shaped.

33. The method of claim 30, further comprising at least two keys defining a spring constant and configured to releasably hold the reflector.

34. The method of claim 30, wherein the reflector defines a side portion tapering inwardly from the bottom section to the top surface.

35. The method of claim 30, wherein a plurality of ridges are defined in the side portion.

36. The method of claim 35, wherein the plurality of ridges are configured to direct the light emission.

37. The method of claim 30, wherein the reflector is a material selected from the group consisting of tin, brass, bronze, aluminum, plastic, polymer, alloy and combinations thereof.

38. The method of claim 30, further comprising the step of reversing a direction of rotation in step c) such that the retaining key slidably disengages the camming portion of the top surface to release the reflector.

39. The method of claim 38, further comprising the substep selected from the group consisting of replacing the reflector with another reflector, temporarily removing the reflector to inspect the light assembly, repainting the reflector and reinserting the repainted reflector, and combinations thereof.

40. The method of claim 30, further comprising a ceramic assembly disposed in the housing for operatively holding the light source.

* * * * *